US009175437B2

(12) United States Patent
Gamba

(10) Patent No.: US 9,175,437 B2
(45) Date of Patent: Nov. 3, 2015

(54) HIGH-PERFORMANCE COMPOSITE CABLE ROPE AND ANCHORING AND SAFETY SYSTEM INCLUDING SUCH A COMPOSITE CABLE ROPE

(71) Applicant: Davide Gamba, Biella (IT)

(72) Inventor: Davide Gamba, Biella (IT)

( * ) Notice: Subject to any disclaimer, the term of this patent is extended or adjusted under 35 U.S.C. 154(b) by 0 days.

(21) Appl. No.: 14/348,856

(22) PCT Filed: Oct. 3, 2012

(86) PCT No.: PCT/IT2012/000306
§ 371 (c)(1),
(2) Date: Mar. 31, 2014

(87) PCT Pub. No.: WO2013/051043
PCT Pub. Date: Apr. 11, 2013

(65) Prior Publication Data

US 2015/0050515 A1 Feb. 19, 2015

(30) Foreign Application Priority Data

Oct. 4, 2011 (IT) ..... BI2011A0010
Oct. 4, 2011 (IT) ..... BI2011A0011

(51) Int. Cl.
*D07B 1/00* (2006.01)
*D04C 1/12* (2006.01)
(Continued)

(52) U.S. Cl.
CPC ..... *D07B 1/005* (2013.01); *A62B 35/00* (2013.01); *A62B 35/0068* (2013.01); *D04C 1/12* (2013.01); *D07B 1/0673* (2013.01); *D07B 1/0686* (2013.01); *E04G 21/3214* (2013.01); *D07B 1/025* (2013.01); *D07B 2201/102* (2013.01); *D07B 2201/1096* (2013.01); *D07B 2201/209* (2013.01); *D07B 2201/2059* (2013.01); *D07B 2201/2088* (2013.01); *D07B 2201/2092* (2013.01); *D07B 2205/201* (2013.01);
(Continued)

(58) Field of Classification Search
CPC ..... D07B 1/005; D07B 1/025; D04C 1/12
See application file for complete search history.

(56) References Cited

U.S. PATENT DOCUMENTS 4,640,179 A * 2/1987 Cameron ..... 87/6
5,137,112 A 8/1992 Nichols
(Continued)

FOREIGN PATENT DOCUMENTS

DE 20202989 6/2002
DE 202004012456 12/2004
(Continued)

OTHER PUBLICATIONS

Molkow W. et al., "Educational Focus: Elevator Suspension Systems Wire Rope for Elevator Suspension," Elevator World, Elevator World Inc., vol. 51, No. 5, (2003).
(Continued)

*Primary Examiner* — Shaun R Hurley
(74) *Attorney, Agent, or Firm* — Steinfl & Bruno LLP

(57) ABSTRACT

A composite cable or rope is described. The cable or rope has an inner metallic rope or core, consisting of a plurality of metal strands, and a plurality of covering layers formed around the inner metallic core. An innovative anchoring and safety system is also described. The system has one or more anchorages, fixed to the roof, in each of which the rope is stably locked by screwing, so as not to create instability problems for people attached to the rope.

12 Claims, 6 Drawing Sheets

(51) Int. Cl.

| | |
|---|---|
| ***A62B 35/00*** | (2006.01) |
| ***D07B 1/06*** | (2006.01) |
| ***E04G 21/32*** | (2006.01) |
| *D07B 1/02* | (2006.01) |

(52) U.S. Cl.

CPC ... *D07B2205/205* (2013.01); *D07B 2205/2014* (2013.01); *D07B 2205/2039* (2013.01); *D07B 2205/3021* (2013.01); *D07B 2401/2005* (2013.01); *D07B 2501/2007* (2013.01); *D07B 2501/2015* (2013.01); *D07B 2501/2092* (2013.01); *D10B 2101/20* (2013.01); *D10B 2321/021* (2013.01)

(56) References Cited

U.S. PATENT DOCUMENTS

| | | | |
|---|---|---|---|
| 5,269,128 | A | 12/1993 | Walton et al. |
| 2002/0079164 | A1 | 6/2002 | Choate |
| 2010/0101833 | A1 | 4/2010 | Zachariades et al. |
| 2010/0187040 | A1 | 7/2010 | Siemienowicz |
| 2011/0189411 | A1 | 8/2011 | Elad et al. |

FOREIGN PATENT DOCUMENTS

| | | |
|---|---|---|
| DE | 202005011463 | 9/2005 |
| EP | 2317029 | 5/2011 |
| EP | 1748104 | 2/2012 |
| FR | 2950408 | 3/2011 |
| NL | 1035225 | 10/2009 |

OTHER PUBLICATIONS

International Search Report mailed on Aug. 6, 2013 for PCT/IT2012/000306 filed on Oct. 6, 2012 in the name of Gamba, Davide.

Written Opinion mailed on Aug. 6, 2013 for PCT/IT2012/000306 filed on Oct. 6, 2012 in the name of Gamba, Davide.

International Preliminary Report on Patentability inclusive of annexes mailed on Jan. 17, 2014 for PCT/IT2012/000306 filed on Oct. 6, 2012 in the name of Gamba, Davide.

* cited by examiner

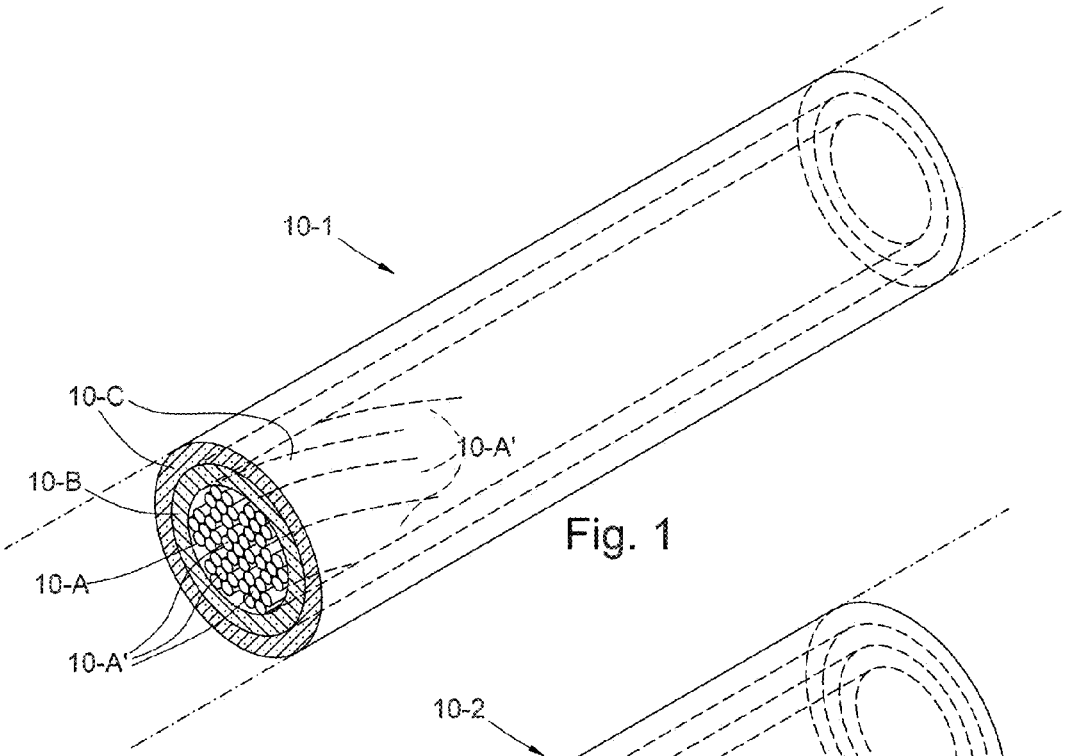
Fig. 1
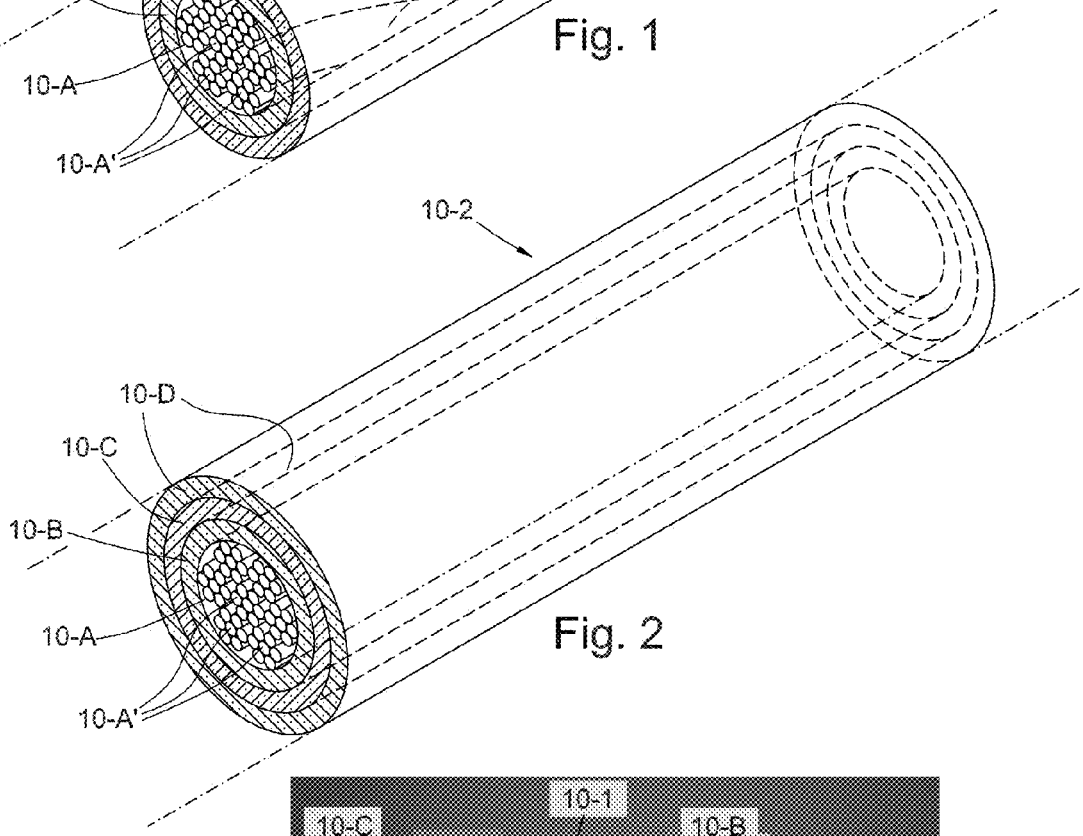
Fig. 2
Fig. 3
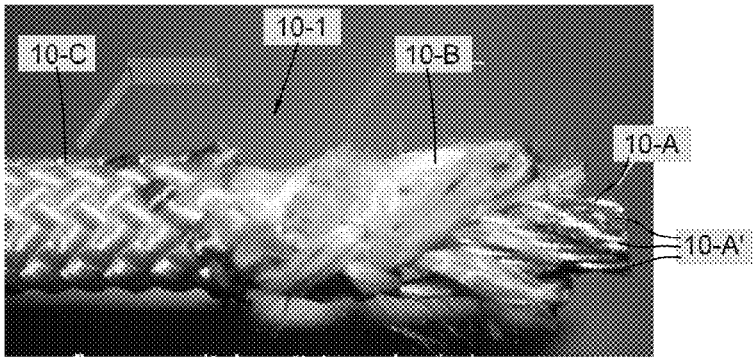

HIGH-PERFORMANCE COMPOSITE CABLE ROPE AND ANCHORING AND SAFETY SYSTEM INCLUDING SUCH A COMPOSITE CABLE ROPE

CROSS REFERENCE TO RELATED APPLICATIONS

The present application is the US national stage of International Patent Application PCT/IT2012/000306 filed on Oct. 3, 2012 which, in turn, claims priority to Italian Patent Applications BI2011A000010 and BI2011A000011 both filed on Oct. 4, 2011.

TECHNICAL FIELD

The present invention generally relates to the technical field of cables, ropes and cords, and more particularly it relates to the field, narrower, of cables, ropes and cords of the composite type, that is of those cables and ropes which are composed of an inner metallic core of steel, in turn covered with one or more coverings or outer layers of protection, and which, therefore, thanks to these additional coverings or layers, exhibit special technical characteristics and performance that distinguish them substantially from the usual uncovered cables and ropes of steel.

The present invention also concerns in general the field of anchoring and security systems that are suitable for offering an anchorage and consequently to render safe critical and potentially dangerous zones, such as the roof of a building, in order to avoid the risk of accidental falls of persons that operate and move in these zones, and more particularly it concerns a cable-type anchoring and safety system, i.e. a system including, as an essential element to provide anchorage and safety, a cable or a rope, and more specifically a cable or rope of the composite type.

BACKGROUND ART

The present technique offers a wide variety of cables, ropes and cords intended for an equally wide variety of applications, and in particular it provides various types and models of composite cables and ropes, i.e. having a central inner core, usually metallic and of steel, that is covered with one or more outer layers or sheaths or coverings.

Despite this wide and varied range, the technology, currently available and applied, cannot be considered entirely free from limitations and drawbacks that deserve to be carefully analyzed in order to get to overcome them.

In particular, as a first consideration, it is observed how the present technique, in proposing covered and composite cables or ropes, has considered and taken into account only a relatively small and limited number of materials with which to make these outer layers and layers, thus ignoring numerous and special materials that the modern technology today makes advantageously available, among which there are cited, by way of example, the special materials known by the commercial names, corresponding to registered trademarks, Kevlar and Dyneema.

In this regard, it is noted, for completeness, that Kevlar is an aramid synthetic fiber, invented by DuPont, which has a high mechanical strength, so as to be, at the same weight, five times stronger than steel.

The Dyneema in turn is a synthetic fiber, invented by the company DSN and consisting of ultra high molecular weight polyethylene, which has a very high strength-to-weight ratio, up to fifteen times greater than that of steel.

Again it is observed that the ropes and cables of steel/metal, such as those usually used in the present technique, appear to be suitable conductors of both electric and electrostatic energy, whereby this characteristic may cause serious problems in certain applications where these phenomena of conduction of electric/electrostatic energy must be absolutely avoided.

Furthermore, the same cable or rope of steel, especially if not covered and protected externally, has the disadvantage, during his working life and at the time of its possible rupture, of constituting a potential cause of damage, such as cuts and/or abrasions, to the persons who work in its vicinity and usually come into contact with it.

The present technique also offers a wide variety of systems directed to provide safety and a possibility of anchoring and grip to an operator who has to operate in critical situations and potentially dangerous areas, for example move on the roof of a house or on a scaffolding of a building in construction, as well as to ensure security and protection against the risk of falling in certain sports and activities such as mountaineering and mountain climbing.

Among these known security and safety systems, many include, as an essential element suitable for providing safety to an operator, a cable or a rope, to which the same operator has the possibility to attach himself, for example via a spring-clip, and then remain firmly attached, while working on the roof, whereby the operator does not run the risk of accidentally falling from the roof where he moves and makes its job, but is in any event held by the cable.

In these known safety systems based on a cable or rope, the rope is usually installed on the structure, such as the roof, to make safe, so as to avoid the risk that an operator can fall from it, by using one or more support elements that support and bind the rope to define its path along the same structure.

However these support elements, in particular those arranged in the intermediate areas of the path of the rope, are usually configured so as not to block the rope, but simply to guide it while leaving it free to slide, whereby the rope, when it is pulled and urged by an operator attached to it, is subject to slide in the area of these support elements, with the consequent risk of creating situations of instability for the operator attached to the same rope.

Therefore, also here, there is to be noted that the known technique has some limitations and drawbacks, and that, moreover, it has in fact neglected and disregarded some interesting possibilities that instead deserve to be carefully considered and exploited more fully in order to improve the characteristics and performance of the safety and anchoring systems currently available, particularly those that include and are based on the use of a cable or a safety rope.

For example it is noted that the actual technique, in the field of safety systems, is based almost solely and exclusively on systems that comprise structures and elements welded together, or forged clamps to which it is possible to attach a safety rope of steel.

It follows that these known systems appear able to provide only a partial and incomplete safety to operators, whereby the risk of accidents, in particular of falls from an height, remains high.

In this regard, it is noted, as resulted from a recent survey, that 47% of accidents in the construction industry is represented by falls from a height, thereby confirming the fact that, despite the precautions and safety systems currently used, the problem persists and requires solutions more effective and efficient than the current ones.

Moreover, as a further consideration, it has to be pointed out that the current security and safety systems, at present available on the market, exhibit very different characteristics and peculiarities, often conflicting with one another, in terms both of their constructive and mechanical configuration and of the type of safety that they are capable of giving, thereby making rather difficult and problematic the selection, from a user, of which specific safety system he has to effectively adopt.

Summarizing, today there are available and known various safety systems that are made up of parts and elements welded together, for example of a bolt which is welded to a base plate, or that comprise forged elements, such as eyebolts or terminals for the passage of a rope of galvanized or stainless steel.

Yet, there are known safety systems including a cable or a rope which is installed and made to run along a structure, e.g. a roof, to be rendered secure against accidental falls of the people working on it, wherein the rope is supported and bound on that structure, while having the possibility of sliding, by means of one or more support elements.

DISCLOSURE OF INVENTION

Now, in the current technical context, as outlined above, the inventor has realized that a thorough study and an extensive experimentation performed on the various outer layers for covering a cable and rope of the composite type, as well as the definition of an appropriate and efficacious combination of these covering layers, can lead to the result of a significant and substantial improvement of the features and operational performance, such as the mechanical strength and the wear resistance, of the composite cable and rope.

In particular the inventor has perceived that numerous and relevant benefits can arise from the principle of covering a rope or a cable of steel with different and appropriate coverings and layers, for example an increase, thanks to this special configuration with layers, both of the tensile strength, as also verified by specific tests carried out at the company Gamba Working Group of Biella and described below, and of the electrical insulation, as well as verified by tests conducted at specific laboratories that deal with safety in the workplace.

Furthermore, the inventor has also faced the problem of overcoming the drawbacks and limitations, above mentioned, of the present technique in this specific field of cables and ropes, in order to ensure both a stable anchorage of the cable that does not to show any failure and instability, and also an effective insulation of it from electrical sources.

At the same time the inventor has turned his attention to try to make a cable or rope, of the composite type, that were able to reduce to a minimum the accidents at work, and also were able to predict, reduce and minimize the negative effects of a possible breakage of the inner core of the cable, for example by ensuring, in this case of breakage, a residual strength and mechanical resistance of the cable so as to delay its complete rupture.

Yet the inventor, starting from and analyzing the prior art and related limits, has faced the problem of improving in a tangible way the characteristics, performances and effectiveness of the safety systems currently in use, and in particular of those which are based on the use of one or more safety cables in order to give a person the possibility of attaching to them, and which typically are intended to be installed on the roofs of buildings or in areas and on similar structures to make them safe against accidental fall of people who work on them.

Therefore a first object, more general, of the present invention is to provide a cable or rope of the composite type, i.e. comprising one or more covering layers formed around an inner core constituted by a rope of steel, which offers concrete and tangible advantages over the composite cables and ropes that are now in use, and in particular it is such as to meet the above discussed requirements, as well as to realize a new composite cable that is the result of a careful and thorough study and experimentation on the materials to be used to make the covering layers of provided for covering the metallic central core.

A second object, however connected to the first, of the present invention is to provide a new and innovative cable, of the composite type, that takes full advantage of the opportunity to exploit certain new materials, and therefore their special properties, today available in the art, in order to significantly improve the characteristics and operational performances of these composite cables.

A further object of the present invention is to provide an anchoring and safety system, of the type including a cable directed to make safe structures such as the roofs of buildings, which system is capable of avoiding the risk of accidents and accidental falls from an height of the people who operate and move on these structures, wherein this anchoring and safety system substantially innovates and is associated with evident and tangible benefits with respect to the various and often non-homogeneous and discordant security systems currently in use and applied, and in particular it is able to provide safer and more reliable anchorage points, and therefore optimum conditions of safety, to the people that operate on these structures to make safe, and also implies a rapid and easy installation on them.

The above objects can be considered fully achieved by the composite cable or rope and by the anchoring and safety system, including a rope, having the characteristics defined.

Particular forms of embodiment of the composite cable or rope and of the anchoring and safety system of the invention are also defined.

Therefore, in summary, in a first aspect, the present invention relates to a composite cable or rope that exhibits high-performance technical characteristics, while, in a second aspect, it concerns an anchoring and safety system, of the type with a cable, that also exhibits high and improved technical and Safety characteristics with respect to the systems and devices for anchoring and giving safety at present in use.

It should be noted that, for the purposes of the present invention and in the respective following description, the terms “cord”, “cable” and “rope” are to be understood as synonyms and can therefore be used interchangeably to indicate substantially the same object or part of the invention.

Also the words “layer”, “coating”, “covering”, “sheath” are to be understood as synonyms and having the same meaning and therefore directed to indicate the same parts of the composite cable of the invention

BRIEF DESCRIPTION OF DRAWINGS

These and other objects, characteristics and advantages of the present invention will appear clearly from the following description of some preferred embodiment thereof, provided solely by way of a non limiting-example, with reference to the accompanying drawings, where:

FIG. 1 is a schematic perspective view, in section, of a first embodiment of a composite cable according to the present invention;

FIG. 2 is a schematic perspective view, in section, of a second embodiment of the composite cable according to the present invention;

FIG. 3 is a photographic view of an effective sample of the composite cable of the invention, in particular conforming to the respective first embodiment of FIG. 1;

Figure 4A:
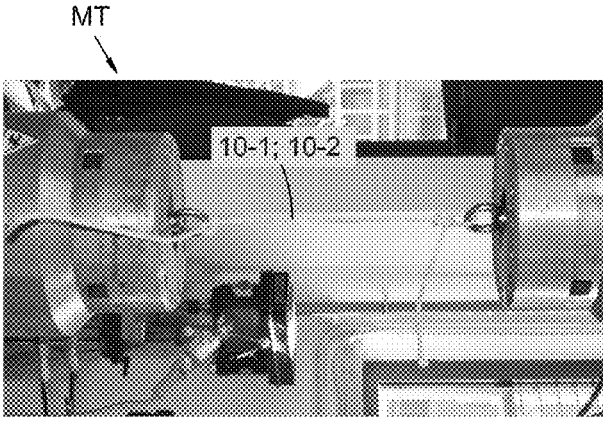
FIGS. 4A-4C are photographic views of some testing equipments used to test the composite cable of the invention.

DETAILED DESCRIPTION OF SOME PREFERRED EMBODIMENTS OF THE COMPOSITE CABLE OR ROPE OF THE INVENTION

With reference to the drawings, FIG. 1 shows a first embodiment, indicated with 10-1, of a composite cable or rope according to the present invention.

In particular, the composite cable 10-1 is composed of a core or metal core, indicated with 10-A, constituted by a usual conventional cable formed from a plurality of steel strands indicated with 10-A', wherein this metal core 10-A is covered with a first layer or covering of Kevlar or in general of an aramid fiber, indicated with 10-B, which first layer 10-A in turn is covered with an additional second layer, indicated with 10-C, consisting of a polymer belonging to the class of polyester, exhibiting high tenacity, whereby the composite cable 10-1 is constituted by and composed of the inner metal core 10-A covered with the two layers of Kevlar and polyester, respectively 10-B and 10-C, of which the latter 10-C, of polyester, is provided on the outer surface of the composite cable 10-1.

It is recalled once again that the Kevlar is a material that, at equal weight, is five times stronger than steel, has a great resistance to heat and decomposes at about 500 degrees without melting.

The FIG. 2 shows a second embodiment, indicated with 10-2, of the composite cable of the invention.

In particular, the composite cable 10-2 is composed of an inner metal core, indicated with 10-A, which is covered with a first layer of Kevlar, indicated with 10-B, in turn covered with a further and additional second layer, indicated with 10-C, consisting of a polymer belonging to the class of polyester, at high tenacity, in turn covered with a further and additional third layer of Kevlar or Dyneema, indicated with 10-D, whereby the cable Composite 10-2, of this second embodiment 10-2 of the invention, is constituted by and composed of the inner metal core 10-A covered with the three layers 10-B, 10-C and 10-D, respectively of Kevlar, polyester, and of Kevlar or Dyneema, of which the latter 10-D, of Kevlar or Dyneema, is arranged externally in the composite cable 10-2.

It is recalled that the Dyneema is a synthetic fiber, invented by the company DSN and consisting of ultra high molecular weight polyethylene, also indicated with the acronym UHMWPE (Ultra High Molecular Weight from English PolyEthylene), which exhibits a very high strength-to-weight ratio, up to fifteen times greater than that of steel.

Therefore the difference between the composite cable 10-2, with triple layering, and the composite cable 10-1, with double layering, resides in the addition of a third outer layer 10-D to the composite cable 10-1 of the first embodiment.

In particular, thanks to this additional outer layer 10-D of Kevlar or Dyneema, the composite cable or rope composite 10-2 appears to be particularly advantageous for being used in lifting systems or in elevators.

In fact, this outer layer 10-D of Kevlar or Dyneema is such as to considerably increase the friction, and thus ensure a lower sliding, between the composite cable 10-2 and the pulleys, of these lifting systems, on which the cable 10-2 is wrapped.

Both the layer 10-B of Kevlar and that 10-C of polyester are made in the form of a fabric consisting of woven and braided threads or yarns, in turn constituted by fibers of these two materials.

For clarity, the photographic view of FIG. 3 shows an actual sample of the composite cable of the invention, conforming to the respective first embodiment 10-1 with two layers, namely with the layer 10-B of Kevlar and that 10-C of polyester.

According to a variant, in the two embodiments 10-1 and 10-2, the layer 10-C can be constituted, instead of only polyester, both of polyester and Kevlar, in a given ratio between these two materials, in order to increase the characteristics of mechanical strength and technical performance of the composite cable.

For example, this percentage may be equal to a 50% in weight of Kevlar and 50% in weight of polyester.

As anticipated, the various and different layers of polyester, Kevlar, and (Kevlar+polyester) are made in a known manner, in the form of a fabric constituted by braided and woven yarns, and with equipment which are also known, on the outside of the metal core 10-A.

Advantageously, the presence of these layers in the form of braided or interlaced yarns allows to avoid or at least mitigate the disruptive and negative effects that are often caused, in the conventional cables, by a rupture of the inner metallic core of steel, and hence to ensure a safety margin and a residual mechanical resistance of the composite cable also in the case of such an event, since the layers yield and are broken only after the rupture of the inner core of steel.

In particular, as resulting from tests carried out at the company Gamba Working Group of Biella, also later mentioned and supplemented with further details, it was found that the composite cable or rope of the invention acquires a higher structural strength, so as to ensure a safety margin, before rupture, which is about 50% of the breaking load or tensile strength of a conventional rope of steel.

For example, numerically, a conventional cable 10-A of steel with a diameter of 6 mm having a breaking load equal to 2510 kg, as declared by the manufacturer, after having been covered in accordance with the embodiment 10-1 so as to assume the configuration with two layers shown in FIG. 1, in particular with a first layer 10-B of Kevlar of thickness=1 mm and a second layer 10-C of polyester also of thickness of 1 mm, has a increase in the tensile strength of 1,000 kg, rising thus to about 3,500 kg.

Still on the basis of numerical data, as resulting from the tests carried out at the firm Gamba Working Group of Biella, it was obtained, always in the case of a composite cable composed of a steel core 10-A of 6 mm plus two layers of 100% Kevlar and 100% polyester both having a thickness of 1 mm, whereby the composite cable assumes an outer diameter of 6+2+2=10 mm, that, after rupture of the inner steel core 10-A at the conditions already above mentioned of 3,500 kg, corresponding to a considerable increase of the breaking load over that of the uncovered cable steel 10-A, the final and total rupture of the composite cable or rope occurs at a later time and at a minimum guaranteed load value ranging from 500 to 1,000 kg.

Turning to the electric aspect of the composite cable of the invention, it has to be noted that the polyester is a material resistant to moisture, water, marine, grease and sunlight and also has properties that remain unchanged and do not depend on the dry or wet state of the polyester.

Kevlar material in turn presents unique and special technical and strength characteristics that make it suitable to be used for example to manufacture flak jackets, whereby the combination of these two materials, i.e. polyester and Kevlar, constitutes an optimal union, in particular in order to provide high performance mechanical strength and to isolate from any power sources and thus protect, from electrical shocks generated by such sources, an operator that has to operate in contact with the composite cable.

The fields of application of the composite cable or rope of the invention are numerous, and for instance include the life and safety lines to be installed for safety and security reasons on the roofs of civil and industrial buildings, safety cords, hoisting cables for industrial use, ropes for mountaineering and mountain climbing, ropes for use in swimming, and many other applications yet.

Furthermore it will be appreciated that the composite cable of the invention, unlike the conventional uncovered steel cables, can conveniently be knotted and loosened for a practically unlimited number of times, always returning to the initial configuration, and also without the risk of damage or impair the resistance and strength of the inner metal core, thanks to the presence of the layers that cover it.

Experimental Tests Performed on the Composite Cable of the Invention

Figure 4B:
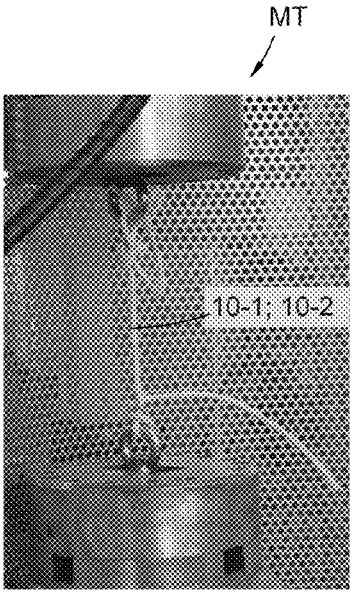
Figure 4C:
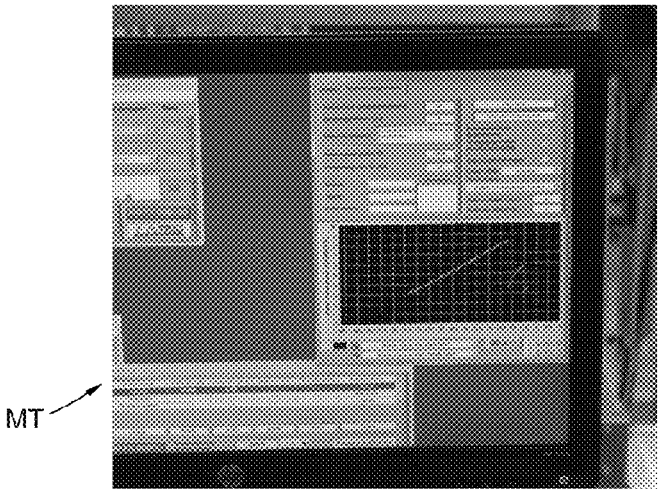

For a more precise and complete information so as to integrate the foregoing description, the photographic views of FIGS. 4A-4C show some of the equipments that were used to test the composite cable of the invention, according to the respective embodiments 10-1 and 10-2, in order to verify its effective characteristics and performance.

In particular, these views show a traction equipment or machine, indicated with MT, used to verify the static behavior and carry out the breaking tests on samples of the composite cable 10-1 and 10-2, and a panel, of the same traction machine MT, which show the evolution of a breaking test.

It is noted that these tests were performed and analyzed in the laboratories of the company Gamba Working Group of Biella, and are part of an experimental activity called "Static strength of composite cables and their connections"

In the following there are indicated the data which define the characteristics of the various parts which make up the composite cable object of the tests.

Characteristics of the Rope of the Inner Core of Steel

| Type | Winding direction | Nominal diameter (mm) | Strength class ($daN/mm^2$), ($Kg/N/mm^2$ | Tensile strength (daN) |
|---|---|---|---|---|
| 7 strands each of 7 steel wires (total 49 wires) | Crossed dx | 6 | 177 | 2510 |

Characteristics of the Fabric of Polyester

| Type | Tenacity (CN/Dtex) | Specific weight ($Kg/dm^3$) | Melting point (° C.) | Water absorption (%) |
|---|---|---|---|---|
| PES HT | 7/8 | 1.38 | 215/220 | 0.5/2 |

Characteristics of the Fabric of Kevlar

| Type | Density ($Kg/dm^3$) | Tensile strength (Mpa) | Elasticity (Mpa) | Elongation (%) |
|---|---|---|---|---|
| Kevlar 29 | 1.45 | 3600 | 83000 | 4 |

Figure 5A:
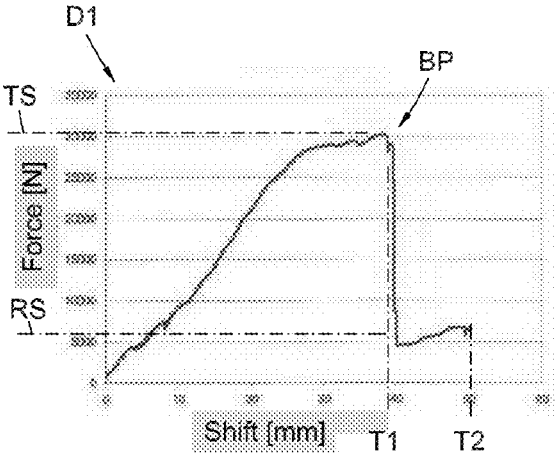
FIG. 5A-5B are diagrams related to experimental tensile tests performed on samples of the composite cable of the invention.
Figure 5B:
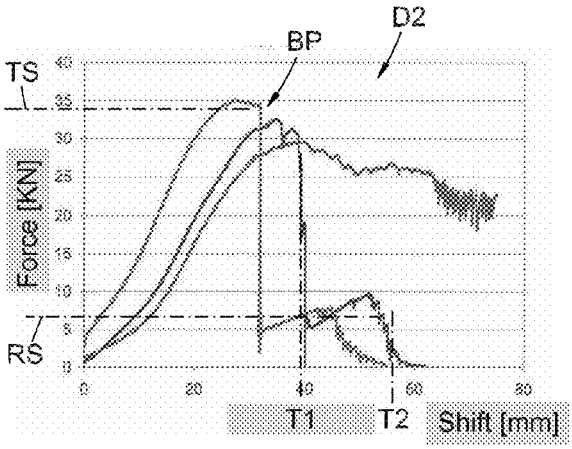

FIGS. 5A-5B in turn refer to diagrams D1 and D2 which illustrate some of the results obtained from the experimental tests carried out on samples of the composite cable of the invention.

As it can be clearly seen from these diagrams D1 and D2, relative to traction testing where a traction force applied to the sample is progressively increased and measured as a function of the corresponding shift or axial deformation of the same sample, the composite cable 10-1 or 102, in the respective breaking point BP corresponding to rupture and breakage of the inner steel core 10-A, exhibits a certain tensile strength indicated with TS.

At this point, of course, the strength of the cable collapses and falls out suddenly, but it does not become completely null, whereby the cable 10-1 or 10-2 exhibits, immediately after the rupture of the inner metallic core 10-A, a residual strength or mechanical resistance, indicated with RS, due to the intervention and the resistance of the layers of Kevlar, polyester, and Kevlar+Dyneema which break only after that rupture of the inner core 10-A.

Therefore, advantageously, the final and complete rupture of the composite cable 10-1 or 10-2 of the invention occurs at a time T2 which is subsequent to the time T1 at which the breaking of the metallic inner core 10-A of steel occurs.

The numerous tests that were carried showed a medium tensile strength TS, or a medium resistance to static breakage, of approximately 28 KN, with a standard deviation of 2 KN, whereby it can be estimated a static strength, with reliability of 99.7%, equal at least to 22 KN.

Detailed Description of Some Preferred Embodiments of the Anchoring System and Safety Composite Cable of the Invention As anticipated, a second important aspect of the invention relates to an anchoring and safety system including, as an essential element suitable for providing safety, a cable or a rope, and in particular a rope of the composite type, with high-performance, such as that described above in detail.

Now, with reference to the drawings and in particular to FIG. 6, a rope-type anchoring and safety system, according to the present invention, also called life-line system as will be understood better later, is indicated in the whole with 20 and comprises:

- a rope of the composite type, indicated with E, consisting of a composite rope for example conforming to the embodiment 10-1 before described, thus composed of an internal core of steel 10-A, which is covered with a first layer 10-B of Kevlar, having in particular the function of preserving the rope E from abrasion, which first layer in turn is covered with a surface second layer 10-C of polyester or Dyneema suitable for protecting the same rope E from atmospheric agents, and one or more anchorages, each indicated as a whole with 21, in which the composite rope E is fixed and locked by screwing, wherein each anchorage 21 in turn is stably fixed and anchored to a structure, indicated with ST and constituted for example by the roof of a building, to make sure and safe by means of the same safety system 20.

The anchorage 21, essential part of the safety system 20 of the invention, exhibits remarkable and innovative features, as hereinafter described in detail, and in particular, unlike those used in the known safety systems, is not constituted by parts welded between them.

Consequently, the anchorage 21 is not subject to structural problems and defects, such as cracks, due to imperfect welds, which may arise and manifest themselves over time due to weathering and thermal expansions and that often afflict welded structures.

Again, advantageously, the anchor 21 does not include forged parts, such as rings, bolts or clamps, for the fixing and the passage of cables.

The anchorage 21 is installed and firmly fixed to the structure ST to make safe.

For example, as already anticipated, the anchorage 21 can abut and be stably fixed to the main load-bearing structure ST of the roof RO or of the roof of a building, by means of a box of metal, indicated with BX, in which it is positioned, through a hole JJ, a tubular element HH, wherein this tubular element HH in turn houses within it an element or threaded stem, indicated with F, of the type of a screw stud having two threads at the ends of opposite sense, one of which, higher, is indicated with F' and the other, lower, screwed into the structure ST, is indicated with F".

In particular, the box BX presents, in addition to the hole JJ for the passage of the tubular element HH, a hole J for the passage of the threaded element F, and also four upper holes KK of larger diameter and four lower holes K of smaller diameter to allow passage of the head and the stem of four fixing screws VH, by means of which the box BX is rigidly fixed to the structure ST.

Figure 6:
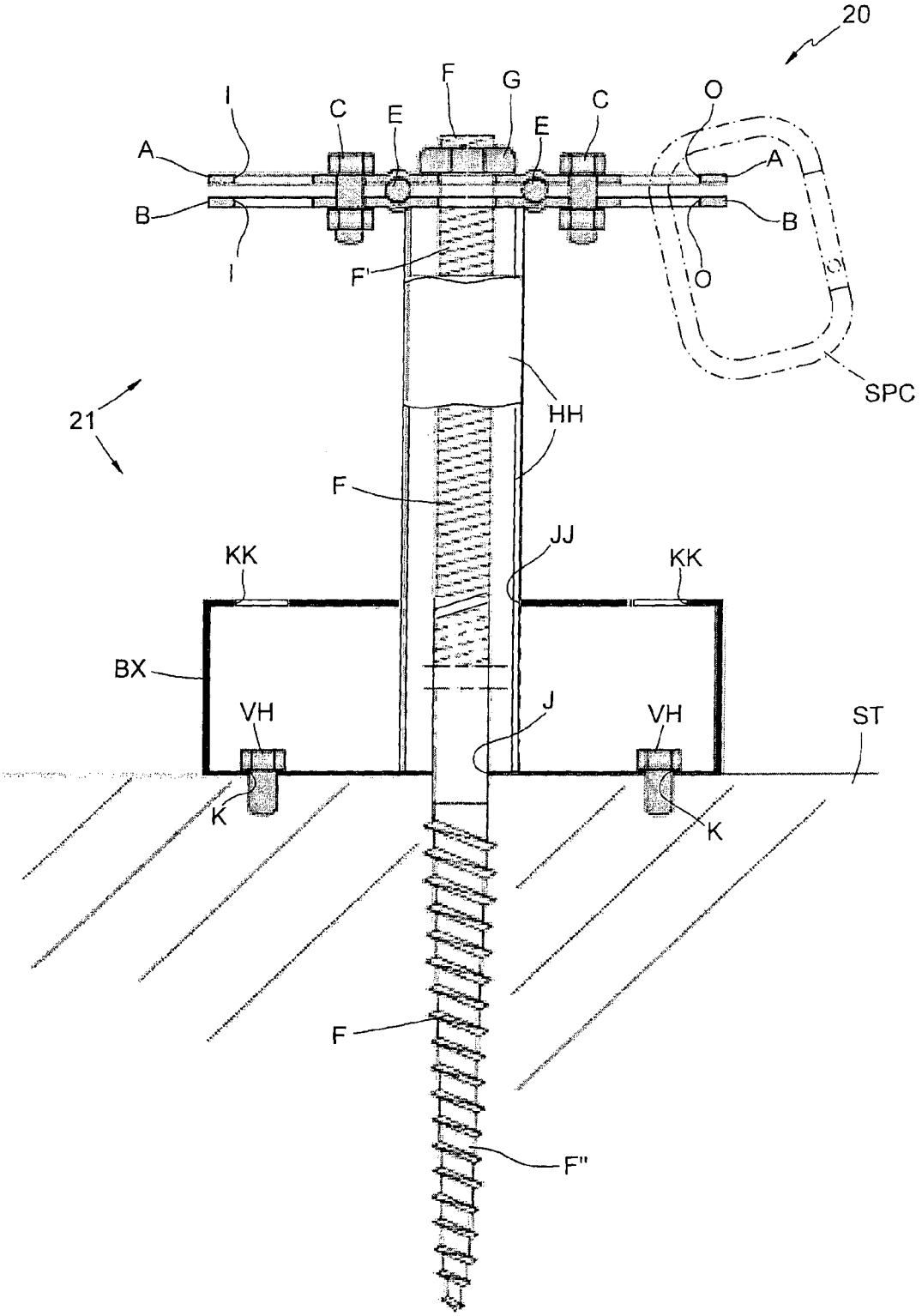
FIG. 6 is a schematic view, with some parts in section, of an anchoring and safety system, according to the present invention, including a cable or rope of the composite type.

As shown in FIG. 6, the anchorage 21 also comprises two plates A and B, for fixing and locking the composite rope E, wherein each of them has a central through hole M (shown in FIG. 6A) and two side through holes, respectively I and O.

These two plates A and B are made by a process of cold forging and each of them has two seats, concave, adapted to receive at opposite sides the passage of the composite rope E in order to house and lock it.

Therefore, by joining and pressing these two plates one against the other, with the interposition of the composite rope E, it is possible to stably lock between them the composite rope E.

In the installation of the safety system 20, in a first phase the box element BX is fixed to the structure ST by means of the four screws VH.

Even the threaded element F is screwed and fixed rigidly to the structure ST, by passing through the hole J of the box BX the lower threaded portion F" of this threaded element F.

Then the two plates A and B of the anchorage 21 are inserted, through their central through hole M, on the tip of the threaded upper portion F' of the threaded element F.

At this point, the two plates A and B are tightened both against each other, with the interposition of the composite cable E, via a pair of bolts C inserted into respective holes L and N (both holes shown in FIG. 6A) formed in the same plates A and B, and against the tubular element HH, which acts as a spacer, by screwing and tightening a nut G on the threaded upper portion F' of the threaded element F.

In this way the stresses due to the tightening of the nut G are distributed in a uniform manner on the various parts of the anchorage 21.

Furthermore, the threaded element F, the two plates A and B and the tubular element H form a single group, compact and integral, which blocks and locks stably the rope E into the anchorage 21 and also makes the latter integral with the safety system or life-line 20 in its whole.

The box BX in turn allows both to distribute on the supporting structure ST the force applied on the anchorage 21, and to make compact the safety system or life-line 20.

For clarity and completeness of information the photographic views of FIGS. 7A-7D show the system of anchorage and safety 20 in its actual installation on the roof RO of a building.

As can be seen from these FIGS. 7A-7D, the anchoring system and safety 20 is usually fixed to the supporting structure of the roof RO ST through more anchorages 21, arranged in appropriate points of the roof RO.

In this way, as can be seen by the same FIGS. 7A-7D, the composite cable E, once it is clamped between the two plates A and B of each anchorage 21, provides a safety line, also called life-line and indicated with LL, suitable for offering a chance of attachment and anchoring to those persons who work in the zone where the safety system 20 is installed, so as to safeguard their life and in particular avoid that they may accidentally fall from an height.

Figure 7A:
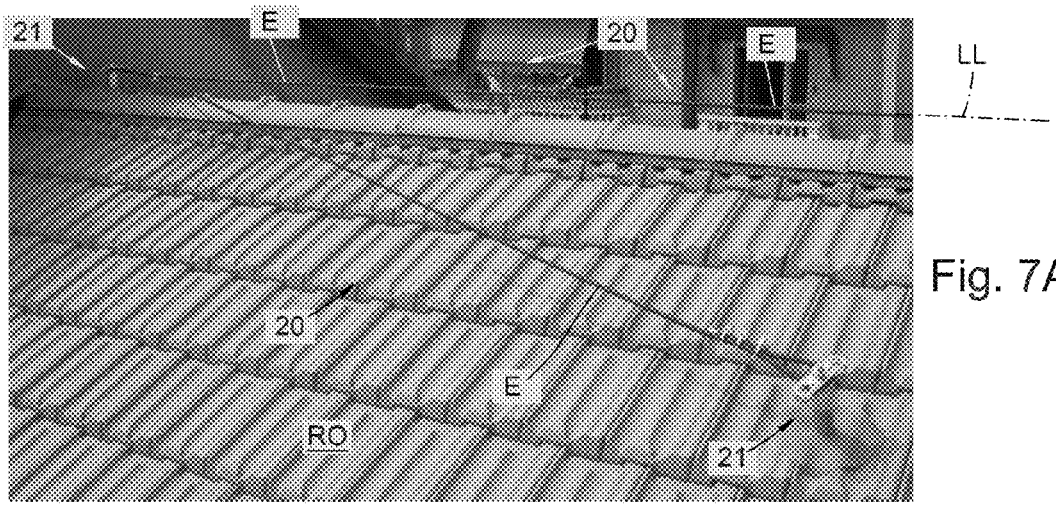
FIGS. 7A-7D are photographic views that show or simulate the anchoring and safety system, according to the present invention, in its actual installation on the roof of a building.
Figure 7B:
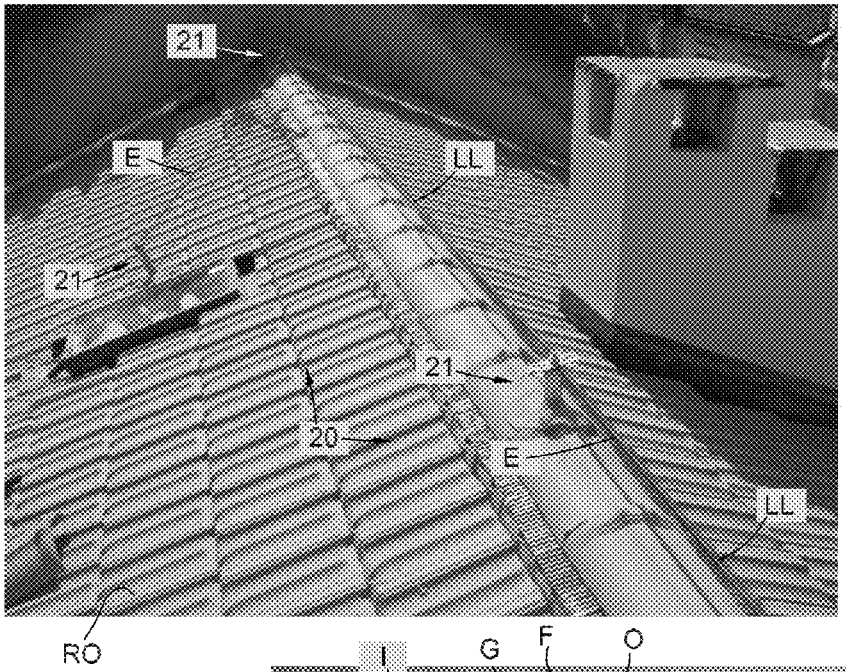
Figure 7C:
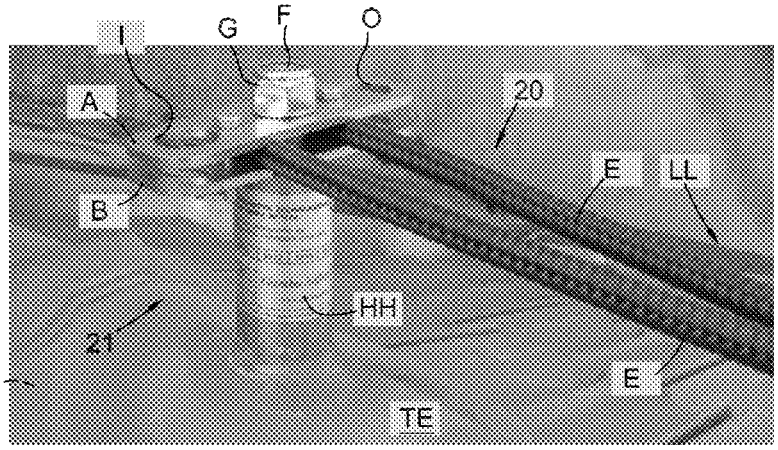

In particular, the FIG. 7C shows, close up, an anchorage 21 around which the rope E is wound, so as to be locked along two respective passages between the two plates A and B.

Figure 7D:
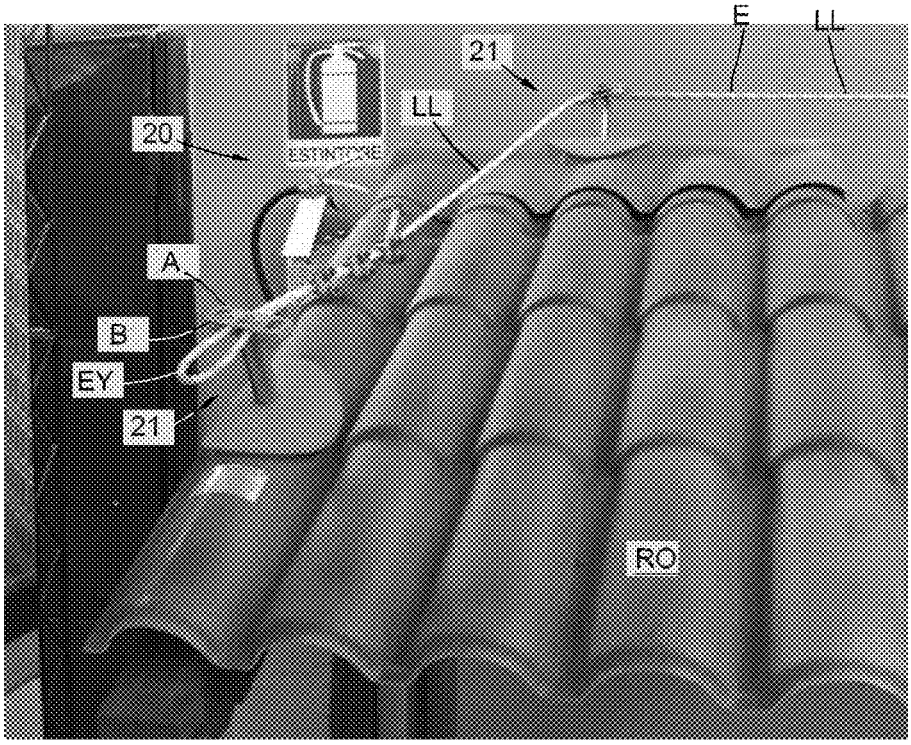

Of course, as also shown in FIGS. 7A, 7B and 7D, the cable E can be locked, into the anchorage 21, only along a passage between the plates A and B, in particular if the anchorage 21 is arranged in an intermediate zone of the life-line LL.

Note also that, in correspondence of the anchorages 21, and in particular of those arranged at an end of the life-line LL, as for example shown in FIG. 7D, the rope E is usually configured so as to form an eyelet EY.

In particular, this eyelet EY, before being firmly clamped between the two plates A and B of the anchorage 21, is disposed in a configuration in which it protrudes from the two plates A and B towards the outside of the life-line LL, whereby the rope forming the eyelet EY is suitable for sliding when a given load is applied to the life-line LL.

This eyelet like configuration, suitable for sliding, with which the cable E is fixed and locked between the two plates A and B is associated with significant advantages in the use of the safety system 20, as hereinafter more fully described.

Figure 6A:
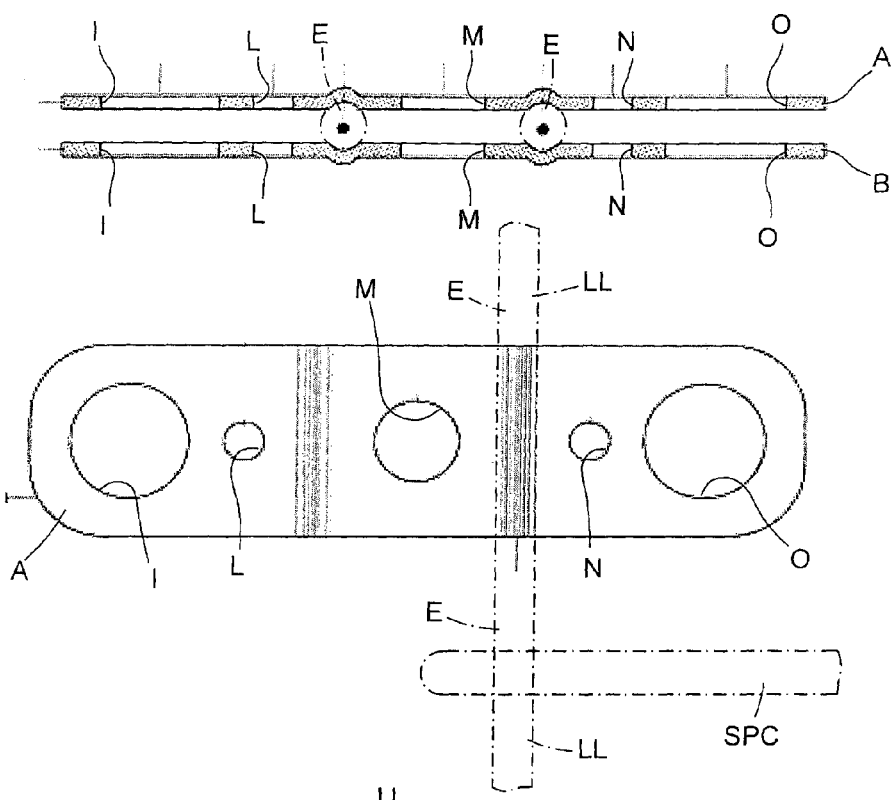
FIGS. 6A and 6B are views of some details and parts of the anchoring and safety system of FIG. 6.
Figure 6B:
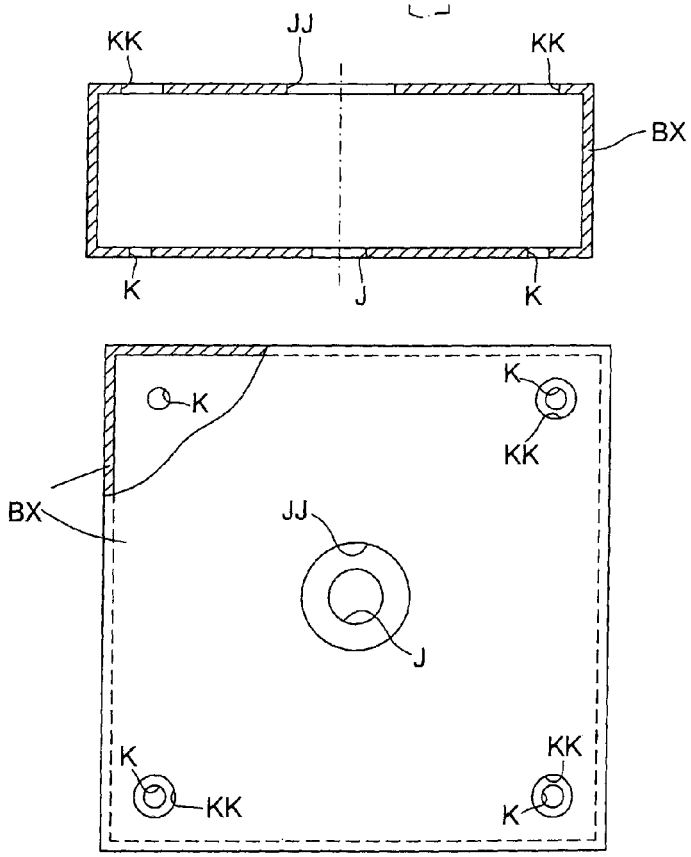

In the use of the safety system or life-line system 20, the operator has the possibility to anchor himself to any of the anchorage 21 of the safety system 20, for example by using a first spring clip, indicated with SPC and represented with a dash-dot line in FIG. 6, which is coupled to the plates A and B of the anchorage 21 and inserted into the respective holes I or O, and also to attach himself to the composite rope E by using a second spring clip SPC, as also shown in dash-dot line in FIG. 6A.

In this way the operator benefits of a double safety.

Furthermore, since the passage of the composite rope E is locked in the region of each anchorage 21, in turn spaced apart from each other with a constant pitch for instance of about 8 meters, the safety system 20 of the invention advantageously allows to eliminate and in any case to lower drastically the risk associated with pendulum effect, as well as to reduce, at equal traction force, in comparison with the cable conventional systems, the yielding of the rope calculated on the entire life-line system.

On the contrary these risks and adverse effects are present in the cable conventional security systems where the cable is not locked and therefore it is free to slide in the intermediate anchorages.

As added benefit, the composite cable E, thanks to its special covering, can be installed with bare hands, without any danger of injury to the operator.

Yet the rope composite E, part of the safety system 20, provides protection and electrical insulation from atmospheric electric shocks.

Furthermore, in the event of a hypothetical rupture of the metallic steel core of the composite rope E, the operator ascertains visually the elongation of the composite rope E, not yet definitively broken, whereby he can promptly intervene and take the necessary safety precautions.

Still, the elasticity of the covering layers of Kevlar and polyester allows to protect the life of the operator, since the complete rupture takes place only at a later time, or after the collapse of the inner core of steel.

Another significant advantage is associated, as before mentioned, with the eyelet configuration, having the possibility of sliding between the two plates A and B, according to which the rope or cable E is fixed to an anchorage 21, in particular arranged at an end of the life-line LL.

In fact, when the safety system 20 or the life-line LL is subject to traction, for example because it must intervene to retain and hold an operator who is accidentally slipped on the roof RO, this eyelet EY is subject to slide between the two plates A and B by means of which it was locked on the anchorage 21.

Therefore this sliding or slipping of the eyelet EY, in the same anchorage 21, has the effect of damping the forces acting in the security system 20, thereby reducing considerably and cushioning the impact suffered by the operator when the life-line LL intervenes to retain him and save his life.

This favorable performance, in the use of the security system 20, has been the subject of careful experimentation always at the firm Gamba Working Group of Biella.

Figure 8A:
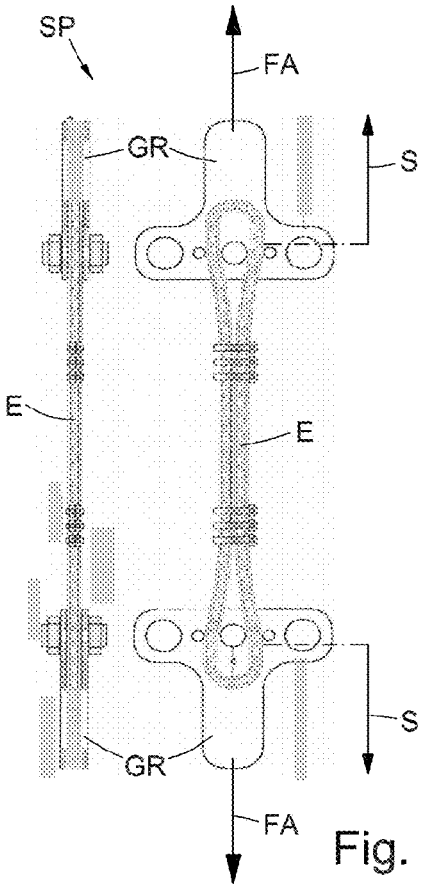
FIGS. 8A and 8B show respectively a specimen of a rope attachment, of the anchoring and safety system of the invention, showing an eyelet configuration and a diagram corresponding to a sliding test performed on this specimen.

In particular there have been made some specimens, of the type shown in FIG. 8A and indicated with SP, in which the rope E, forming an eyelet EY, is grasped and gripped at the ends of the specimen SP by means of GR grips that simulate the tightening of the same cable E between the plates A and B, wherein these specimens SP were subjected to traction in a testing machine, in order to check and measure, as a function of the tensile load or axial force FA applied to the specimen SP, the sliding or shift S of the eyelet EY until its full recovery in the grips GR.

Figure 8B:
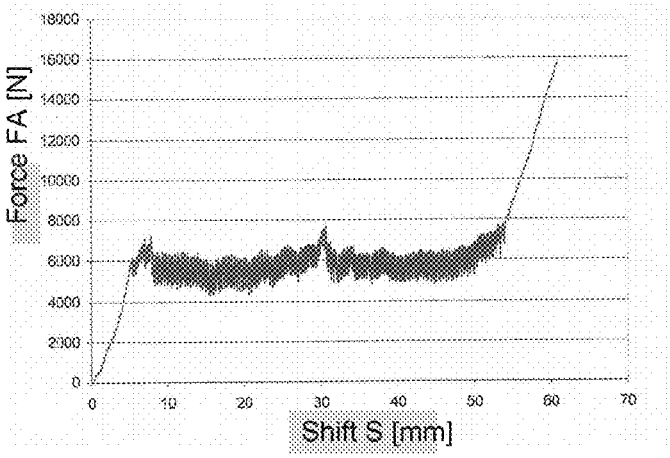

The diagram of FIG. 8B, in turn, shows the result of one of these sliding tests.

As can be seen from this diagram, the axial force FA applied to the specimen SP, after an initial increase, assumes an oscillatory behavior, in a range between about 4.5 and 6.5 KN, which corresponds to a slip of the rope E for recovering completely the eyelets EY in their grips, wherein this fluctuating force FA is justified by the so-called phenomenon of "stick-slip", determined by the difference existing between the coefficient of static and dynamic friction between the rope and their end grips in the specimen SP.

It is therefore clear from these tests, that the safety system A, in case of intervention to save the life of a user and prevent it from falling, whereby the life-line LL is subject to a certain tensile stress, advantageously reacts by allowing and activating the sliding of the eyelet EY, in the respective anchorages 21, so as to reduce considerably the impact suffered by the user during such an intervention of the safety system 20 to save his life.

Finally the safety system exhibits a great flexibility, so as to be suitable for being easily installed and adapted to any type of roof and cover to be secured.

Therefore, thanks to these characteristics, the safety system or the life-line of the invention appears to be adapted to be advantageously applied in a multiplicity of circumstances and to be installed on various types of structures, in particular on roofs and the coverings of civil and industrial buildings to the purpose of making sure and without risks to workers the periodic maintenance of antennas, gutters, replacing shingles, so as to meet the safety regulations prescribed by law and in particular by the law relating to the risk of falling from a height exceeding 2 meters Variants Of course, without prejudice to the principle and the basic concepts of the present invention, the forms of embodiment and details of construction of both the composite cable rope and the anchoring and safety system including a rope, here proposed, may be varied widely with respect to what has been described and illustrated hitherto, without thereby departing from the scope of the same invention.

For example, the layers of Kevlar and Dyneema instead of being constituted by a fabric formed of woven or braided threads or yarns, in turn constituted by fibers of Kevlar and Dyneema, can be constituted by a fabric consisting of continuous, i.e. non-fibrous, filaments, braided, still constituted by these materials.

Still, the rope, which is used in the anchoring and safety system 20 of the invention, can even be a conventional and known cable or rope, either of the composite type, i.e. having a central core, metallic or not, that is covered with one or more layers or sheaths, or of the non-composite type, i.e. be an uncovered rope, thereby not exhibiting on its outer surface any protective layer or sheath.

The invention claimed is:

1. A composite cable comprising:

an inner metallic core consisting of a plurality of metallic strands, and a plurality of layers formed around said inner metallic core, said plurality of layers comprising:

a first fabric layer braided with yarns or threads of aramid fibers or filaments comprising aramid, which first layer is formed around and directly covers said inner metallic core, and a second fabric layer braided with yarns or threads of polyester fibers, which second layer is formed around and covers said first layer, wherein said composite cable is configured such that, at the tensile strength of the inner metallic core, the composite cable does not break completely, but the inner metallic core ruptures, while said fabric layers covering said inner metallic core maintain a residual strength of the composite cable.

2. The composite cable according to claim 1, consisting of said inner metallic core, said first fabric layer, and said second fabric layer, whereby said second layer is arranged on the outer surface of the composite cable.

3. The composite cable according to claim 1, wherein the composite cable comprises a further third fabric layer that is:

(i) braided with yarns or threads of para-aramid fibers or ultra high molecular weight polyethylene fibers, or both; or (ii) braided with filaments comprising para-aramid or ultra high molecular weight polyethylene, or both, which third layer is formed around and covers said second layer formed around and covering said first layer.

4. The composite cable according to claim 3, consisting of said inner metallic core, said first fabric layer, said second fabric layer, and said third fabric layer, whereby said third fabric layer is arranged on the outer surface of the composite cable.

5. The composite cable according to claim 1, wherein:

(i) said first fabric layer also comprises polyester fibers, or (ii) said second layer also comprises aramid/para-aramid fibers or filaments, or (iii) both (i) and (ii), wherein the aramid/para-aramid fibers or filaments and the polyester fibers are present together in a ratio of 50% each by weight of the fabric.

6. The composite cable according to claim 1, wherein the diameter of the inner metallic core is about 6 mm, and the thickness of the fabric of each of said layers is about 1 mm.

7. The composite cable according to claim 1, wherein the composite cable comprises a further third fabric layer braided with yarns or threads of para-aramid fibers or ultra high molecular weight polyethylene fibers, or braided with filaments comprising para-aramid or ultra high molecular weight polyethylene, which third layer is formed around and covers said second layer formed around and covering said first layer.

8. The composite cable according to claim 1, wherein said first fabric layer is further braided with polyester fibers.

9. A method for securing a structure against an accidental fall from a height by a person operating or moving on the structure, comprising:

attaching the person operating or moving on the structure to the composite cable according to claim 1, which composite cable is anchored to the structure.

10. The composite cable according to claim 8, wherein i) the aramid fibers or filaments of the first fabric layer and ii) the polyester fibers of the first fabric layer are each in an amount of 50% by weight of the first fabric layer.

11. The composite cable according to claim 1, wherein said second fabric layer is further braided with aramid fibers or filaments.

12. The composite cable according to claim 11, wherein i) the aramid fibers or filaments of the second fabric layer and ii) the polyester fibers of the second fabric layer are each in an amount of 50% by weight of the second fabric layer.

* * * * *